US011102587B2

(12) United States Patent
Park et al.

(10) Patent No.: US 11,102,587 B2
(45) Date of Patent: Aug. 24, 2021

(54) HYBRID ACOUSTIC APPARATUS INCLUDING RECTANGULAR MICROSPEAKER

(71) Applicant: BUJEON CO., LTD., Ansan-si (KR)

(72) Inventors: Minkoo Park, Hwaseong-si (KR); Seungwoo Chun, Hwaseong-si (KR)

(73) Assignee: BUJEON CO., LTD., Ansan-si (KR)

( * ) Notice: Subject to any disclaimer, the term of this patent is extended or adjusted under 35 U.S.C. 154(b) by 19 days.

(21) Appl. No.: 16/751,225

(22) Filed: Jan. 24, 2020

(65) Prior Publication Data

US 2021/0195315 A1 Jun. 24, 2021

(30) Foreign Application Priority Data

Dec. 19, 2019 (KR) ..... 10-2019-0170324

(51) Int. Cl.

| | |
|---|---|
| ***H04R 23/02*** | (2006.01) |
| ***H04R 1/02*** | (2006.01) |
| ***H04R 1/04*** | (2006.01) |
| ***H04R 1/26*** | (2006.01) |
| ***H04R 7/04*** | (2006.01) |
| ***H04R 7/12*** | (2006.01) |
| ***H04R 7/18*** | (2006.01) |
| ***H04R 9/02*** | (2006.01) |
| ***H04R 9/06*** | (2006.01) |
| ***H04R 11/02*** | (2006.01) |

(52) U.S. Cl.

CPC ..... *H04R 23/02* (2013.01); *H04R 1/025* (2013.01); *H04R 1/04* (2013.01); *H04R 1/26* (2013.01); *H04R 7/04* (2013.01); *H04R 7/12* (2013.01); *H04R 7/18* (2013.01); *H04R 9/025* (2013.01); *H04R 9/06* (2013.01); *H04R 9/063* (2013.01); *H04R 1/023* (2013.01); *H04R 11/02* (2013.01); *H04R 2400/11* (2013.01)

(58) Field of Classification Search

CPC ..... H04R 1/026; H04R 1/025; H04R 7/04; H04R 7/12; H04R 7/18; H04R 2400/11; H04R 1/1075; H04R 1/24; H04R 1/403; H04R 1/406; H04R 9/08; H04R 9/45; H04R 9/63; H04R 2400/15; H04R 23/02

See application file for complete search history.

(56) References Cited

U.S. PATENT DOCUMENTS

2015/0146911 A1* 5/2015 Vieites ..... H04R 9/043 381/398
2019/0037319 A1* 1/2019 Ishii ..... H04R 1/24

FOREIGN PATENT DOCUMENTS

KR 10-2014-0077101 A 6/2014
KR 10-1958257 B1 7/2019

* cited by examiner

*Primary Examiner* — Sunita Joshi
(74) *Attorney, Agent, or Firm* — KORUS Patent, LLC; Seong Il Jeong

(57) ABSTRACT

Disclosed herein is a hybrid acoustic apparatus. The hybrid acoustic apparatus includes: a rectangular microspeaker used as a first acoustic device; and a second acoustic device integrated with the microspeaker. The microspeaker includes a plate configured to constitute a part of a magnetic field part, a magnet configured to be disposed beneath the plate, a diaphragm configured to be disposed on the plate, and a frame configured to accommodate the diaphragm, the plate, and the magnet. A path of vibration sound generated by the diaphragm is formed to be perpendicular to a direction in which the diaphragm vibrates so that the vibration sound is discharged through a side surface of the diaphragm.

2 Claims, 17 Drawing Sheets

HYBRID ACOUSTIC APPARATUS INCLUDING RECTANGULAR MICROSPEAKER

CROSS-REFERENCE TO RELATED APPLICATION

This application claims the benefit of Korean Patent Application No. 10-2019-0170324 filed on Dec. 19, 2019, which is hereby incorporated by reference herein in its entirety.

BACKGROUND

1. Technical Field

The present invention relates to a hybrid acoustic apparatus including a rectangular microspeaker. More specifically, the present invention relates to a hybrid acoustic apparatus including a rectangular microspeaker that can implement the maximization of an effective area through a rectangular design in order to overcome the limited effective vibration area of a circular microspeaker.

2. Description of the Related Art

Generally, microspeakers, such as earphones, are widely used for converting electrical signals into acoustic signals in portable electronic devices such as smartphones, portable communication terminals, notebook computers, MP3 players, etc.

As shown in FIG. 1, such a type of microspeaker includes: a driver which includes a diaphragm 6', a plate 8', a magnet 10', and a yoke 12'; a frame 4' which accommodates the driver therein; and a housing 2' which accommodates the frame 4' and on the entrance of which is mounted an ear cap configured to enable insertion into the ear. The cross section of the housing 2' is circular to facilitate insertion into the ear. Accordingly, each part of a driver module and the frame 4' are also formed to be circular. Although the circular microspeaker is advantageous for a reduction in the size of products, it has the disadvantage of a small effective vibration area.

Unlike the earphone of FIG. 1, some of the microspeakers which are mounted on electronic parts adopt a flat structure including rectangular parts and a rectangular frame. However, a sound discharge path extends in a forward direction (the left direction of FIG. 1) as in the microspeaker of FIG. 1, and this direction is the same as the direction in which a diaphragm vibrates. However, a sound discharge path does not necessarily have to coincide with the direction of vibration. In addition, a product in which a rectangular microspeaker is applied to an earphone has not been commercialized yet.

The inventors of the present invention have developed a microspeaker having a completely new structure that discharges vibration sound to a side rather than a top with respect to a diaphragm, unlike the conventional microspeakers. Furthermore, in order to secure the performance of this microspeaker, it has been recognized that a rectangular microspeaker is an optimal design to maximize an effective vibration area.

Furthermore, the inventors of the present invention have developed a rectangular acoustic apparatus including a microspeaker. This acoustic apparatus may be implemented by various combinations and forms. This acoustic apparatus may further include a speaker, a BA (balanced armature), or a microphone.

SUMMARY

An object of the present invention is to provide a rectangular microspeaker which can implement the maximization of an effective area through a rectangular design in order to overcome the limited effective vibration area of a circular microspeaker.

Another object of the present invention is to provide a hybrid acoustic apparatus that can divide a frequency band and thus produce a distinctive tone through the combination of a rectangular microspeaker and another acoustic device integrated with the rectangular microspeaker.

In order to accomplish at least one of the above objects, the present invention provides a hybrid acoustic apparatus including: a rectangular microspeaker used as a first acoustic device; and a second acoustic device integrated with the microspeaker; wherein the microspeaker includes a plate configured to constitute a part of a magnetic field part, a magnet configured to be disposed beneath the plate, a diaphragm configured to be disposed on the plate, and a frame configured to accommodate the diaphragm, the plate, and the magnet, and wherein a path of vibration sound generated by the diaphragm is formed to be perpendicular to a direction in which the diaphragm vibrates so that the vibration sound is discharged through a side surface of the diaphragm.

The second acoustic device may be any one of another microspeaker, a balanced armature (BA), and a microphone disposed above or below the microspeaker to discharge the vibration sound through the same side surface as the microspeaker.

The acoustic apparatus may be a vertically vibrating hybrid speaker, the microspeaker may be an upper microspeaker, and the other microspeaker may be a lower microspeaker.

The acoustic apparatus may be a hybrid acoustic apparatus including a microspeaker and a BA, the communication between the microspeaker and the BA may be blocked by a plug that passes between the microspeaker and the BA, and the sound wave of the BA may flow through a BA sound discharge opening toward a sound discharge opening, the vibration sound of the microspeaker may flow through the space between the diaphragm and the plug toward the sound discharge opening, and the sound wave and the vibration sound may be independently discharged through the side surface.

The acoustic apparatus may be a hybrid acoustic apparatus including a microspeaker and a microphone, an upper frame configured to accommodate the microphone may also function as the grill of the microspeaker, and parallel paths may be formed above and below the grill and communicate with the sound discharge opening.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Individual embodiments according to the present invention are merely examples that help an understanding of the present invention, and the present invention is not limited to the embodiments. The present invention includes the combination of at least any one or more of individual elements and functions included in the individual embodiments.

A hybrid acoustic apparatus according to the present invention includes a first sound device and a second sound device. Typically, the first sound device is a rectangular microspeaker.

<Rectangular Microspeaker Structure>

First, a rectangular microspeaker 1 according to the present invention will be described in detail with reference to the accompanying drawings.

Figure 1:
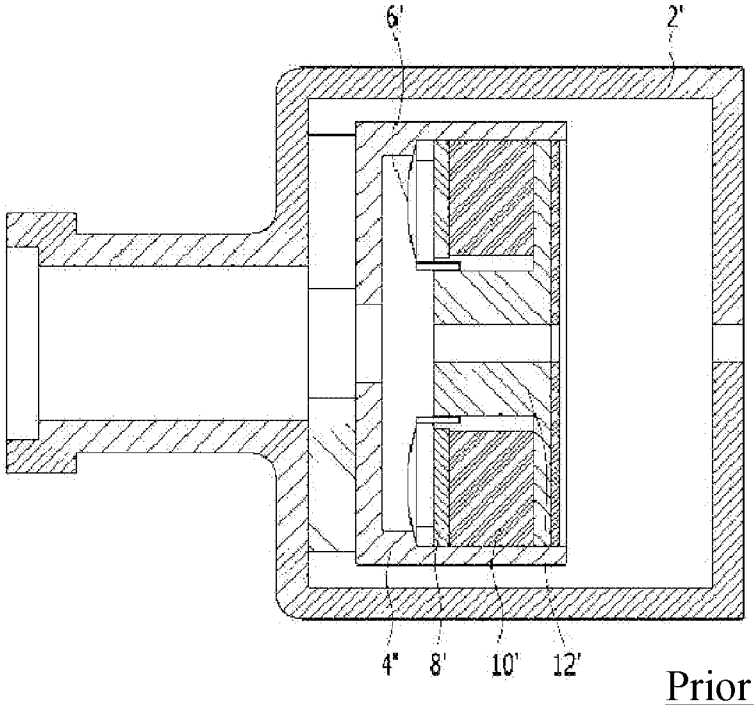
Prior Art FIG. 1
FIG. 1 is a sectional view of a conventional earphone.
Figure 2A:
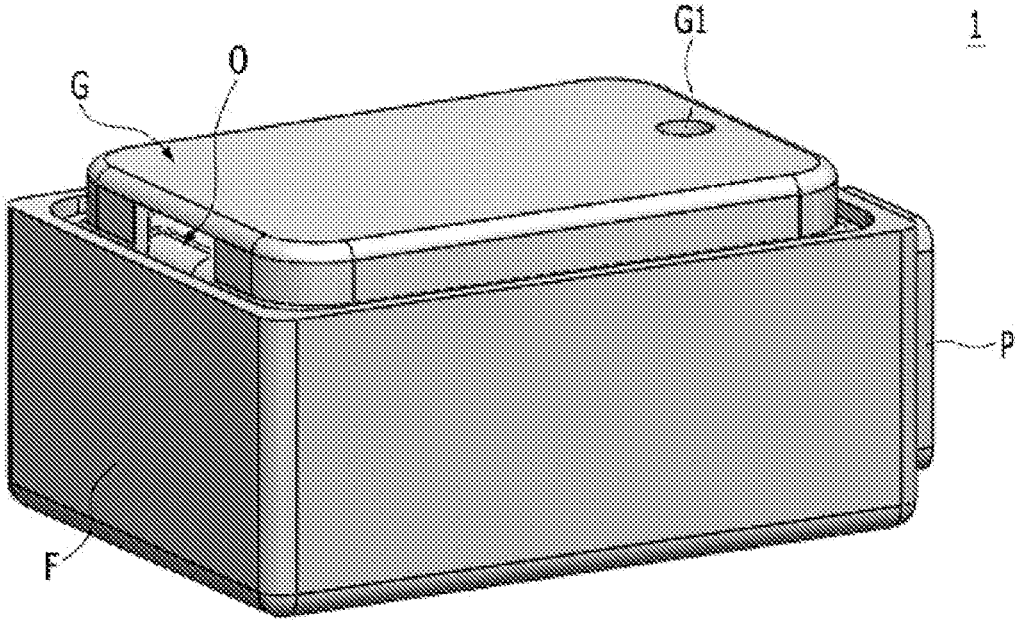
FIG. 2A is an external perspective view of a microspeaker according to an embodiment of the present invention.
Figure 2B:
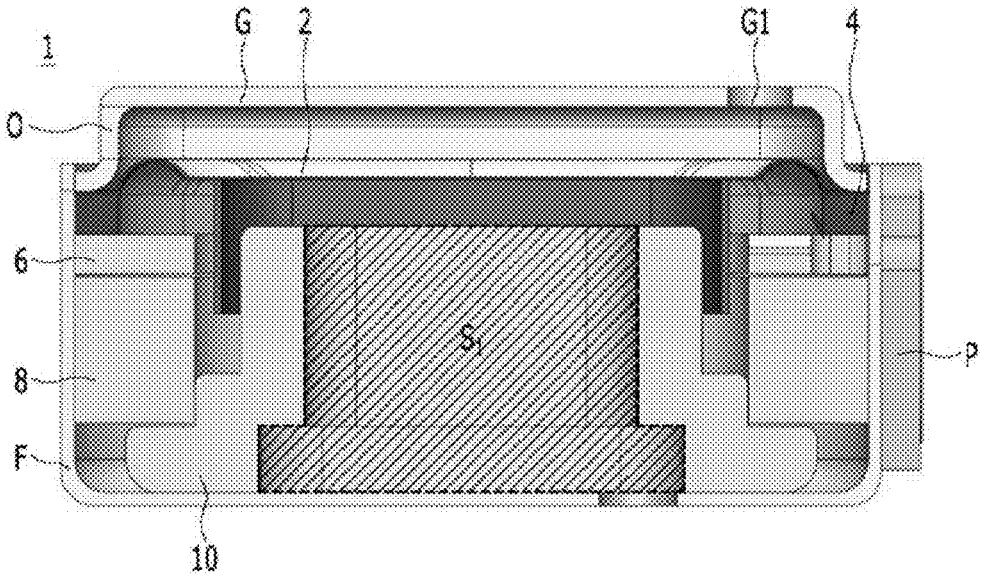
FIG. 2B is a sectional view taken along the longitudinal center line of the microspeaker shown in FIG. 2A.
Figure 2C:
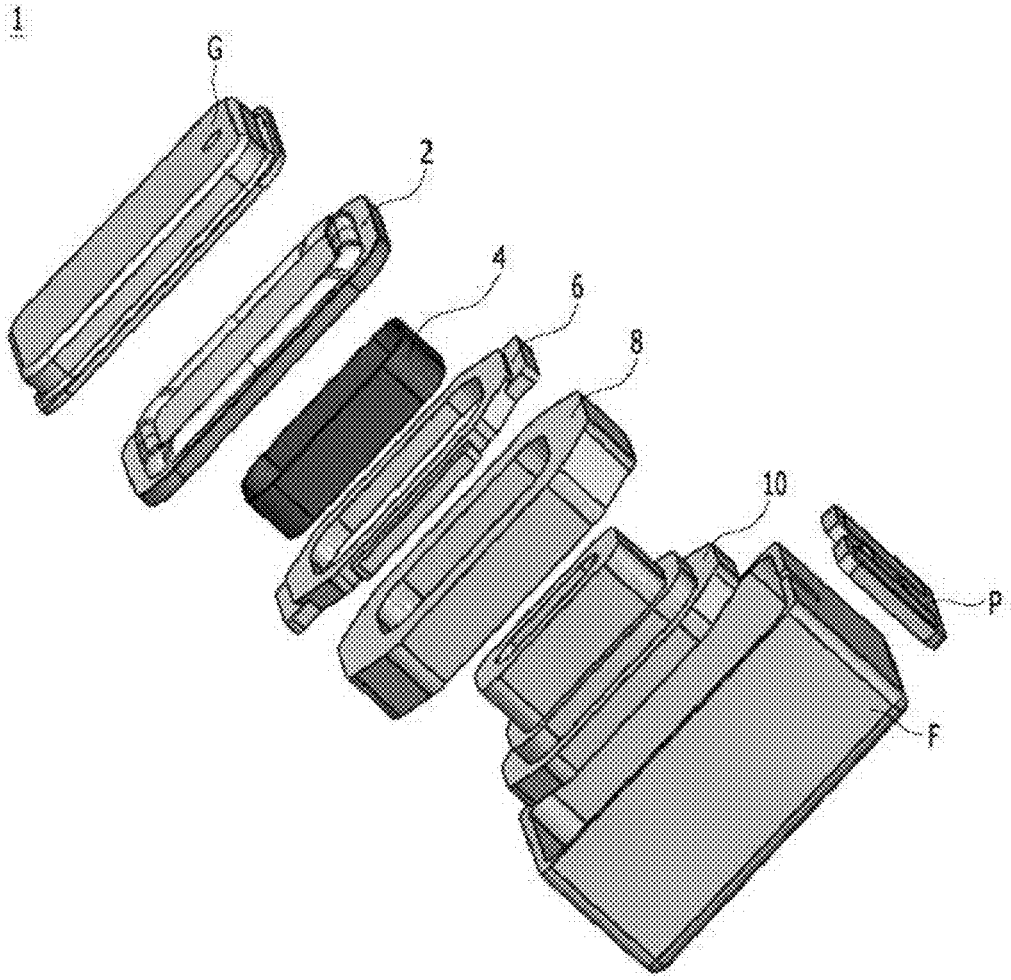
FIG. 2C is an exploded assembly view of the microspeaker shown in FIG. 2A.

FIG. 2A is an overall perspective view of the microspeaker 1 of the present invention, FIG. 2B is a sectional view taken along a longitudinal center direction line, and FIG. 2C is an all parts assembly view.

Referring to these drawings together, the microspeaker 1 includes a diaphragm 2, a support ring 4 disposed along the lower edge of the diaphragm 2, and a plate 6 and magnet 8 disposed under the support ring 4. A yoke 10 is disposed in a space between the plate 6 and the magnet 8, and the lower portion of the yoke 10 protrudes toward the magnet 8 and provides a wide space S1, as shown in FIG. 2B. A grill G is disclosed on the diaphragm 2. A frame F is bonded to the periphery of the grill G, and accommodates speaker parts under the diaphragm 2. A voice coil C is disposed along a boundary between the center and edge domes of the bottom surface of the diaphragm 2. A PCB P electrically connected to the voice coil C is disposed at a location covering a side surface of the frame F, e.g., the right surface of the frame F, other than the bottom of the yoke 10, unlike in the conventional technology.

Although an F-type speaker in which the magnet 8 is disposed outside the yoke 10 has been described in the illustrated example, the present invention is applied to both a P-type speaker in which a magnet 8 is disposed inside the yoke 10 and a composite-type speaker.

FIG. 2B desirably shows the features of the microspeaker 1 of the present invention. The external shape of the microspeaker 1 is formed as a rectangle as a whole. Accordingly, the grille G has a top surface having a rectangular shape. The edges of the grille G are bent downward. The frame F provides a rectangular space, and the upper edges of the frame F are bonded to the ends of the bent portions of the grille G. Alternatively, the edges of the bent portions of the grille G may abut on the frame F, e.g., in a curling manner. A long rectangular slot is formed in a side of the grille G, e.g., the left side of the grille G, at the center of one of the bent portions. This is a sound discharge open O through which the sound of the diaphragm 2 is emitted. A hole G1 formed in the top of the grille G at a distant location facing the sound discharge opening O is intended to balance air pressure by releasing high-pressure external air acting on the ear canal.

In the present invention, the vibration generated by the diaphragm 2 is discharged to the outside through the sound discharge opening O opened through the side. In other words, the vibration direction of the diaphragm 2 itself and the traveling direction of an effective sound wave are perpendicular to each other. Although the sound discharge opening O may be made as a rectangle or oval slot, it may be variously modified to ensure excellent sound quality.

The sound discharge opening O may be formed in the frame F, other than the grille G. Furthermore, the sound discharge opening O may transfer the vibration sound of the top surface of the diaphragm 2, but may also emit the vibration sound of the bottom surface of the diaphragm 2 through the side surface.

According to the present invention, it can be understood that the parts accommodated in the grille G and the frame F do not need to be fabricated in a circular shape as before. As shown in FIG. 2C, the diaphragm 2, the support ring 4, the plate 6, the magnet 8, and the yoke 10 each have long opposite rectilinear upper and lower sides in accordance with the shape of the frame F, and both short sides are each formed by combining a straight line and an inclined or rounded portion, thereby showing a rectangular appearance as a whole.

The advantages of the present invention having the configuration of the rectangular microspeaker 1 will be described with reference to FIGS. 3A to 3C and FIG. 10.

Figure 3A:
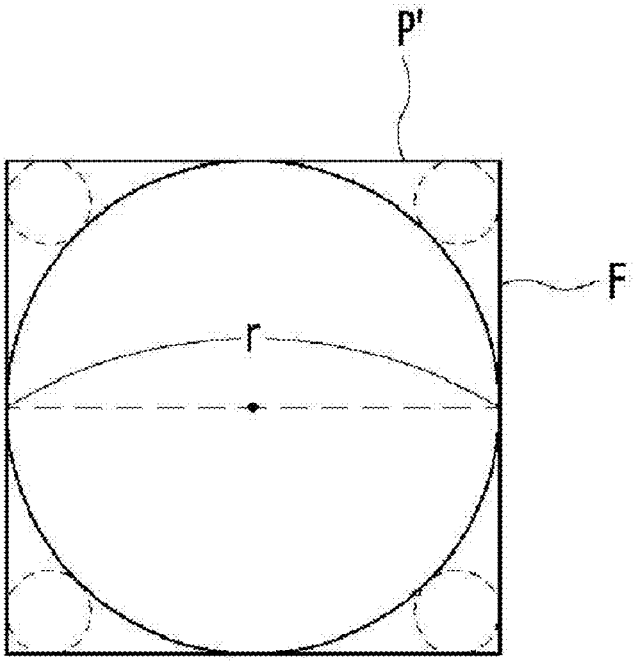
FIG. 3A is a view showing a circle and a square surrounding the circle.

In general, when the area of a circle having a diameter r and the area of a square having each side length r are compared with each other, as shown in FIG. 3A, the latter has an about 30% larger area, thereby increasing a mounting area for parts. According to the present invention, the microspeaker 1 is fabricated in a rectangular shape having two longer sides, the rectangular shape can theoretically ensure a wider mounting area than a square shape.

According to the experimental results of the inventors, as a result of comparing a circular microspeaker having a diameter of 6 mm and the rectangular microspeaker 1 having the same volume as the former microspeaker, the effective vibration area of the diaphragm 2 was increased by about 29%. Furthermore, as shown in FIG. 16, the sound pressure increased by 3 dB or more could be obtained at 10 kHz or lower, which is a main audible band.

The circular microspeaker can increase an internal volume by reducing the size of a magnetic field part composed of the yoke, the magnet and the plate, but the loss of magnetic flux density is large. In contrast, the rectangular microspeaker 1 may maximize an internal space volume while maintaining a stable magnetic flux density.

More specifically, as shown in FIG. 2B, a lower space protruding outward from a space provided by the yoke 10 below the magnet 8 may be additionally secured.

Figure 3B:
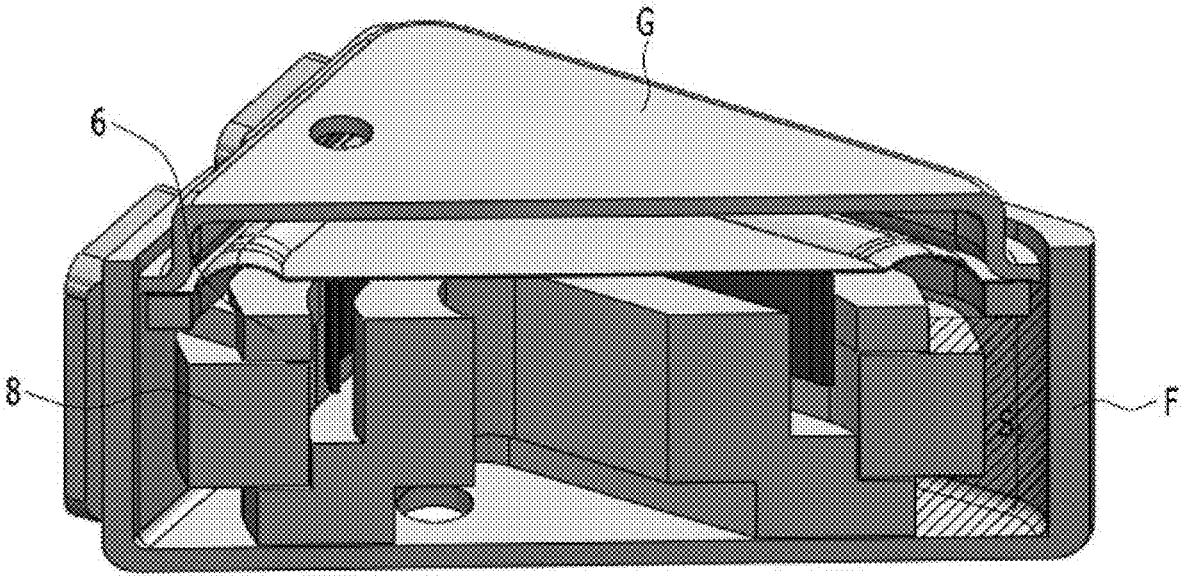
FIG. 3B is a diagonal sectional view showing a state in which additional spaces constituting a conduit are secured in the corner portions of the rectangular spaces of a microspeaker.

Furthermore, as shown in FIG. 3B, additional spaces S2 constituting a conduit may be secured in four corner portions (see the dotted line region in FIG. 3A) of the rectangular space. The microspeaker 1 of FIG. 3B is shown as a microspeaker in which the additional spaces S2 are secured by cutting away the outer portions of the plate 6 at respective corners and disposing the rectangular magnet 8 having inclined surfaces with the corner portions chamfered or rounded, as shown in FIG. 2C.

Figure 3C:
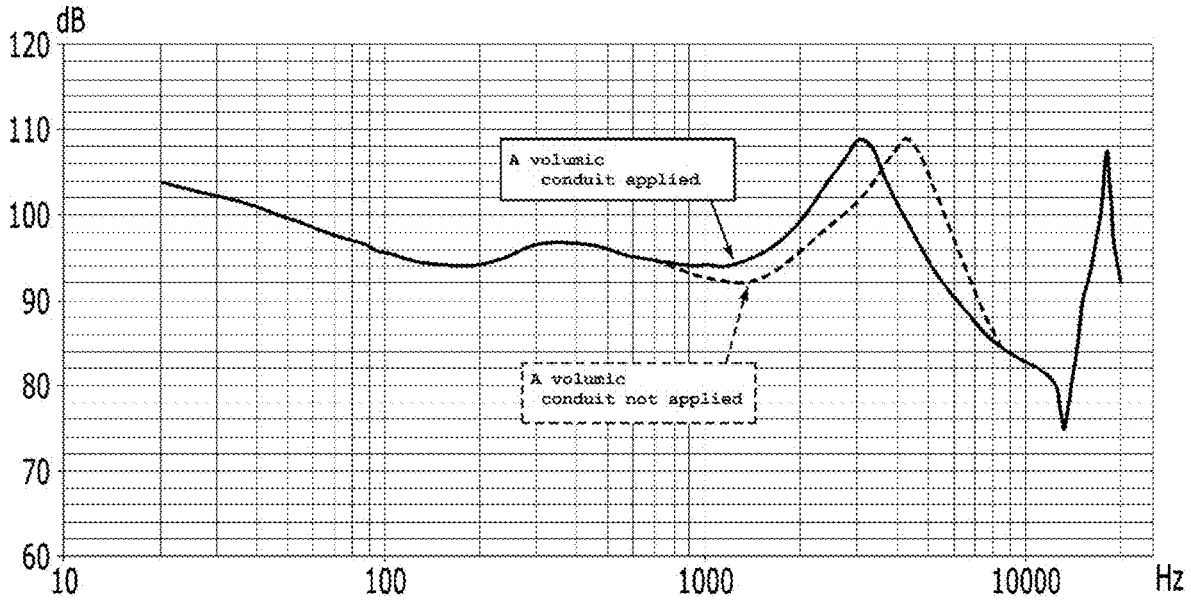
FIG. 3C is a frequency-sound pressure graph comparing a case where additional spaces are secured with a case where additional spaces are not secured.

FIG. 3C is a frequency-sound pressure graph comparing a case where the additional spaces S2 are secured with a case where the additional spaces S2 are not secured. It can be seen that if a volumic conduit is added, the sound pressure is high in the frequency range of 1 to 5 kHz. Otherwise, the sound pressure is high at the frequency range of 5 to 10 kHz. Therefore, the location of an acoustic resonance part may be controlled by appropriately changing the volume or installation location of the volumic conduit.

According to the present invention, by adopting the rectangular microspeaker 1, there can be achieved the advantages of increasing an effective vibration area and expanding an internal space without loss of magnetic flux density.

Moreover, when the advantages of the rectangular microspeaker 1 are utilized, it is also possible to dispose the sound discharge opening in the front surface of a frame in a direction identical to the vibration direction of the diaphragm.

Various modifications may be made to the present invention within the scope of the above-described technical spirit. These embodiments are disclosed in Korean Patent Application No. 10-2019-0096290 (filed on Aug. 7, 2019) of the present applicant.

In an embodiment of the present invention, there will be described a hybrid acoustic apparatus 100 into which the rectangular microspeaker 1 and the second acoustic device are assembled. The microspeaker 1 may be obtained by appropriately modifying any one of the embodiments disclosed in the above-described Korean patent application of the present applicant as well as the above-described embodiment.

<Vertically Vibrating Hybrid Speaker>

Figure 4A:
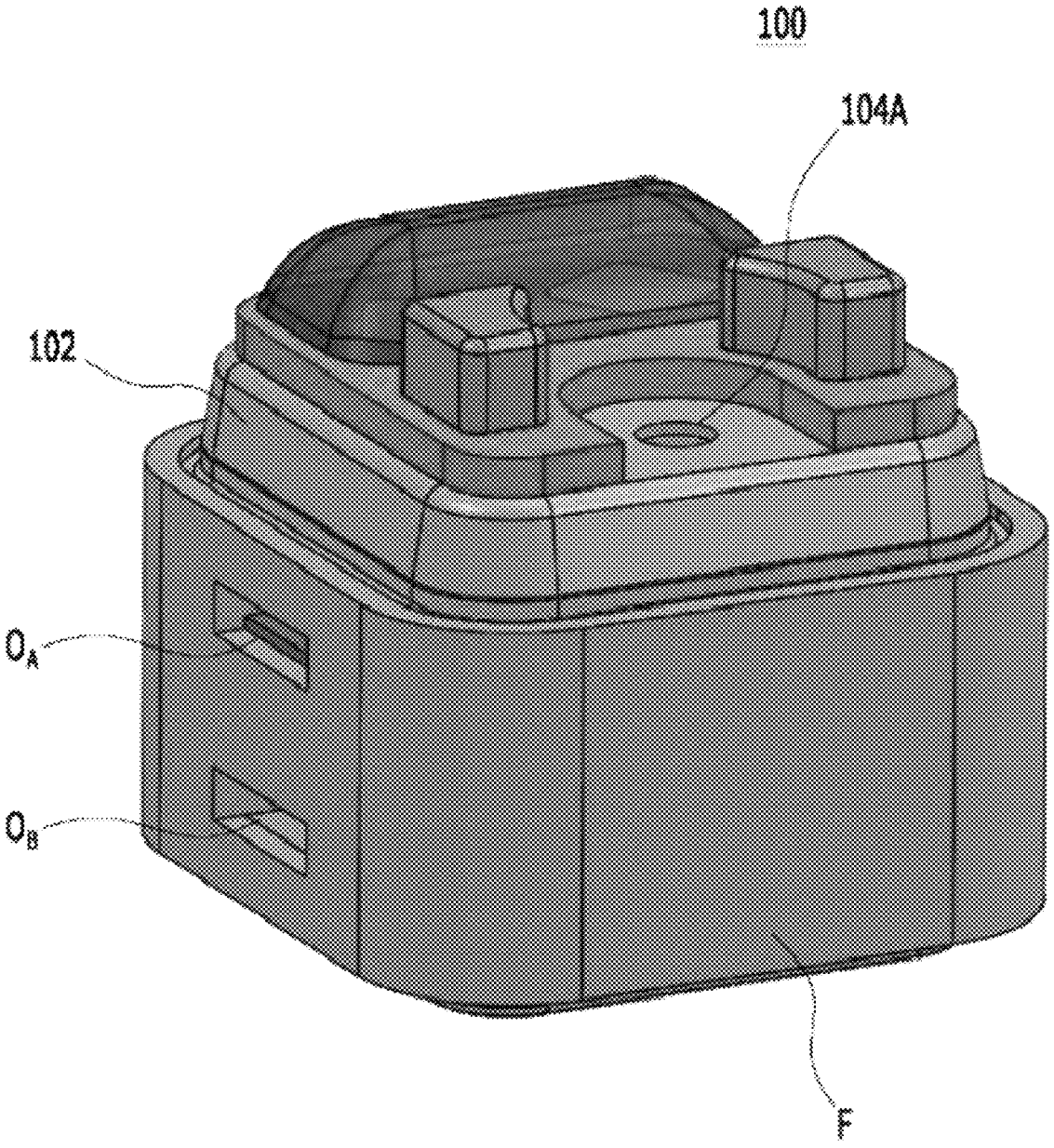
FIG. 4A is a perspective view showing the overall appearance of an acoustic apparatus according to an embodiment of the present invention.

FIG. 4A is a perspective view showing the overall appearance of an acoustic apparatus 100 according to an embodiment of the present invention. The acoustic apparatus 100 is generally rectangular because it is based on a rectangular microspeaker. A rectangular cap 102 closes the top surface of a frame F, and backhauls 104A and 104B are formed in the top surface of the cap 102. The backhauls 104A and 104B are formed to ensure the smooth vibration of the diaphragm and to control the characteristics of the diaphragm and an internal volume. Sound discharge openings include two sound discharge openings, i.e., an upper sound discharge opening $O_A$ and a lower sound discharge opening $O_B$.

Figure 4B:
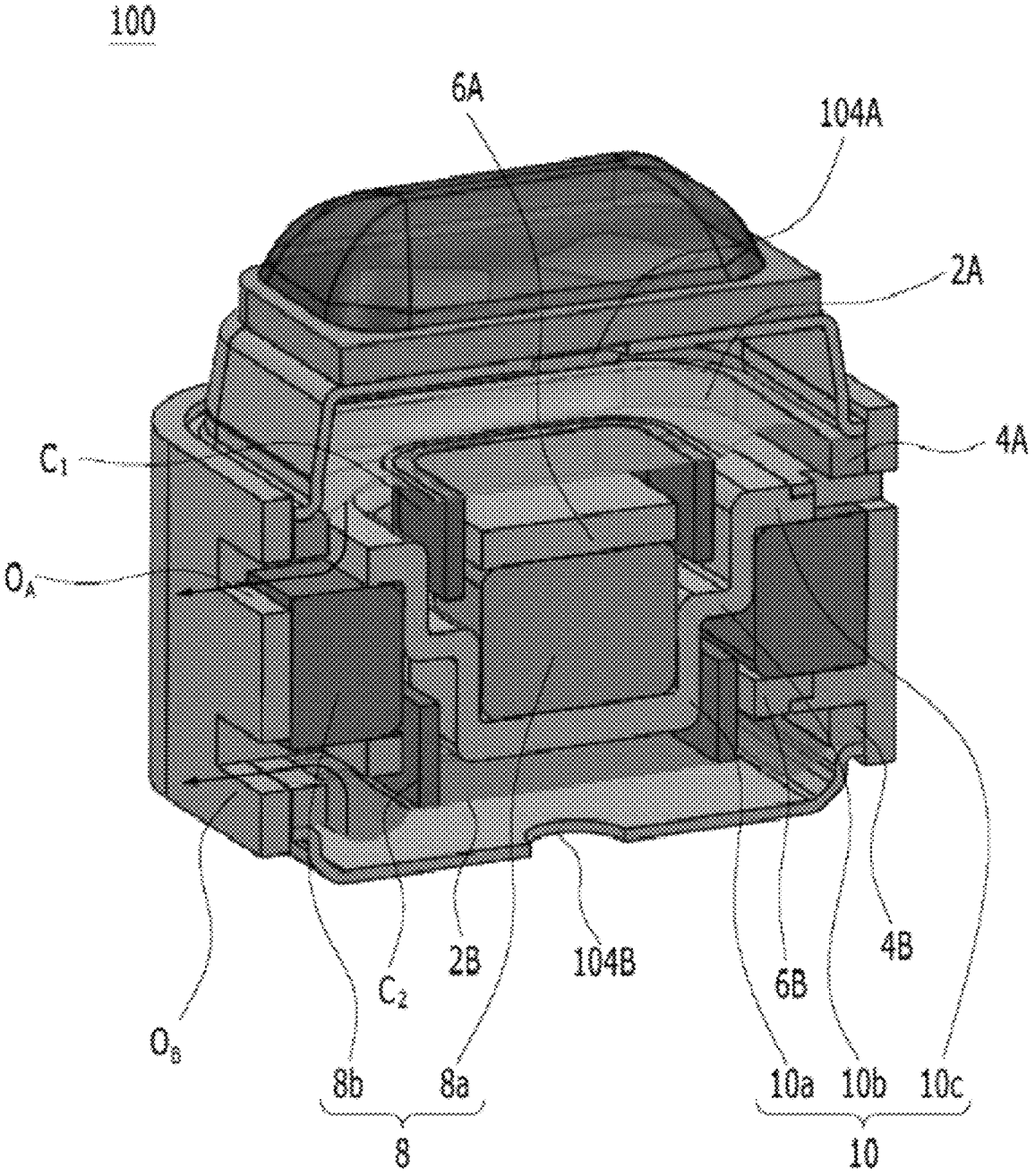
FIG. 4B is a sectional perspective view of the acoustic apparatus shown in FIG. 4A.

FIG. 4B is a sectional perspective view of the acoustic apparatus 100 shown in FIG. 4A. The acoustic apparatus 100 is implemented as a vertically vibrating hybrid speaker. Each of two diaphragms 2 and each of two coils C constituting the driving module of a speaker are disposed in each of the upper and lower portions so that they are symmetrical to each other.

The yoke 10 includes a U-shaped lower portion 10*a*, an extended portion 10*b* horizontally extended outward from the lower portion 10*a*, and an upper portion 10*c* extended outward from the extended portion to have an inverted L sectional shape. The lower portion 10*a* accommodates a first magnet 8*a* in the center thereof, and a second magnet 8*b* is located beneath the bottom surface of the upper portion 10*c*.

As shown in the drawing, the upper diaphragm 2A and the upper coil C1 are located under the cap 102 of the frame F, and an upper support ring 4A and a drum safety filter (DSF) are disposed beneath the bottom surface of the outer edge of the upper diaphragm 2A. An upper plate 6A is disposed on the first magnet 8*a* inside the upper coil C1 at substantially the same height as the upper portion 10*c*.

The lower diaphragm 2B and the lower coil C2 are located on the bottom surface of the frame F upward, and a lower support ring 4B is disposed on the top surface of the outer edge lower diaphragm 2B. A lower plate 6B is disposed around the lower coil C2 beneath the second magnet 8*b*.

An upper sound discharge opening $O_A$ is formed in the side surface of the frame F, and communicates with a space formed above the second magnet 8*b*. A lower sound discharge opening $O_B$ is also formed in the side surface of the frame F, and communicates with a space formed below the second magnet 8*b*. When a driver is operated, the vibration sound of the upper diaphragm 2A is discharged through the upper sound discharge opening $O_A$ via a space above the second magnet 8*b*, and the vibration sound of the lower diaphragm 2B is discharged through the lower sound discharge opening $O_B$ via a space below the second magnet 8*b*.

Accordingly, according to an embodiment of the present invention, each of the diaphragms divides and reproduces a frequency band by using the acoustic apparatus in which the sound discharge openings are formed in the side surface thereof as a rectangular hybrid acoustic apparatus, thereby producing a stereophonic, distinctive tone.

Figure 5A:
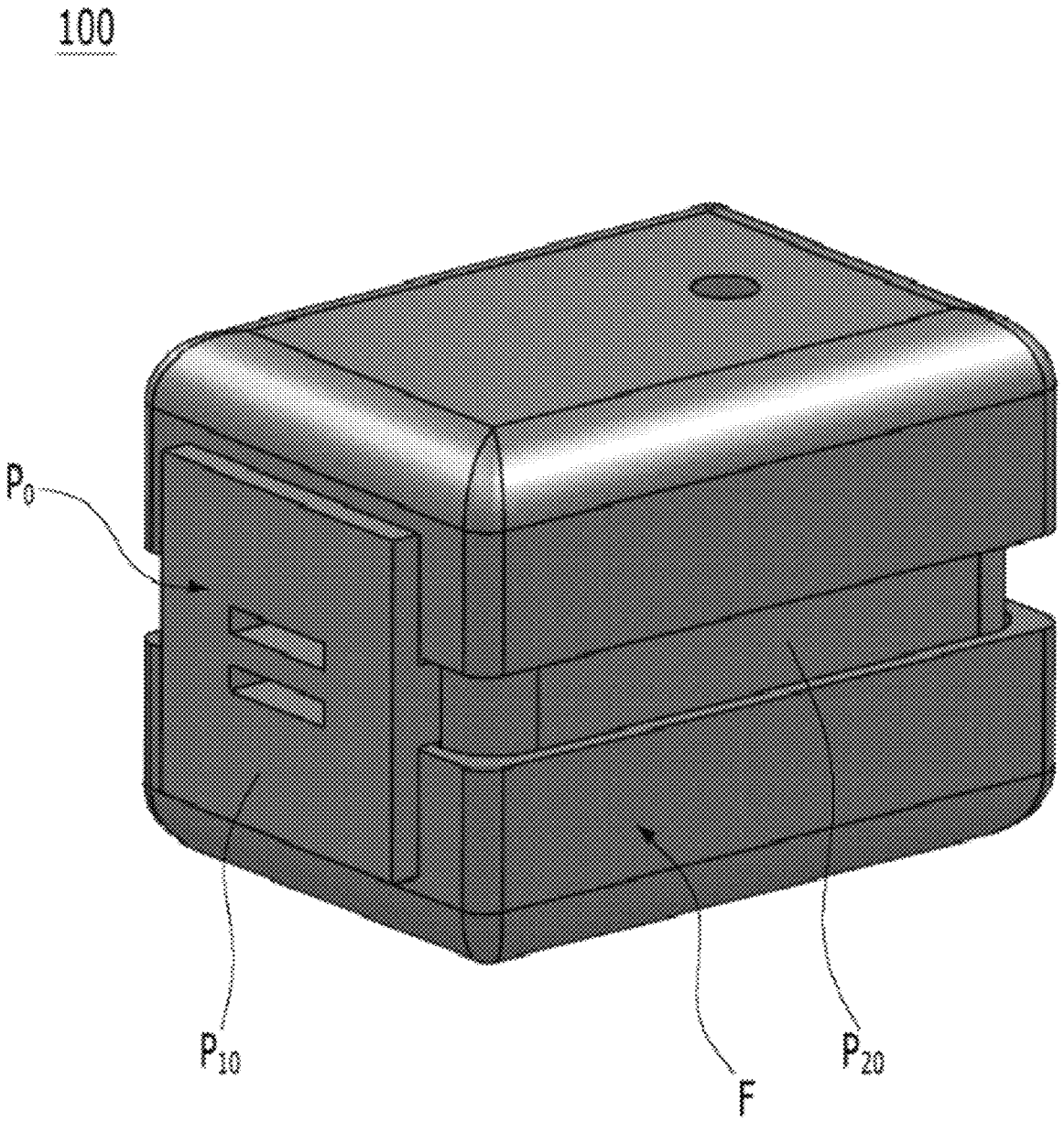
FIG. 5A is a perspective view showing the overall appearance of an acoustic apparatus according to another embodiment of the present invention.
Figure 5B:
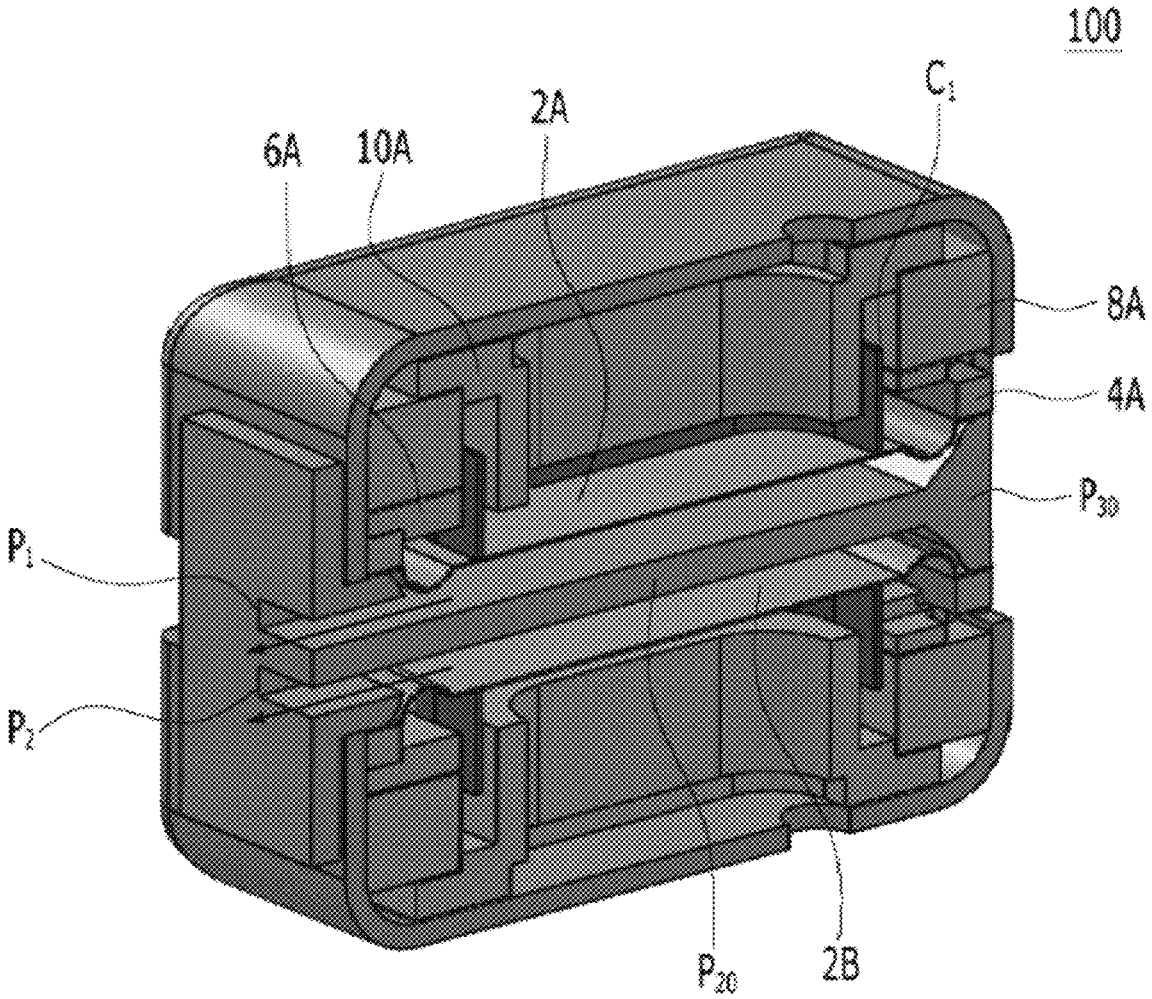
FIG. 5B is a sectional perspective view of the acoustic apparatus shown in FIG. 5A.

FIG. 5A is a perspective view showing the overall appearance of an acoustic apparatus 100 according to another embodiment of the present invention, and FIG. 5B is a sectional view of FIG. 5A. The acoustic apparatus 100 is generally rectangular because it is based on a rectangular microspeaker. Although the acoustic apparatus 100 is implemented as a vertically vibrating hybrid speaker in the same manner as the above-described embodiment, the embodiments are different from each other in that the upper and lower structures of the acoustic apparatus 100 according to the present embodiment are symmetrical to each other in that the upper and lower structures are substantially the same. The following description will be given with a focus on the upper structure.

A plug $P_0$ is disposed in an area where the frame F is exposed across the center portion of the acoustic apparatus 100. The plug $P_0$ includes a side surface $P_{10}$, a barrier $P_{20}$ formed to extend long from the center of the side surface $P_{10}$ to the other side, and an auxiliary side surface $P_{30}$ formed to extend from an end of the barrier $P_{20}$ in an integrated manner. In other words, the appearance of the acoustic apparatus 100 is a composite structure of a frame F and the plug $P_0$. First and second sound discharge openings $P_1$ and $P_2$ are formed in such a manner that portions above and below the barrier $P_{20}$ are opened in the center portion of the side surface $P_{10}$. A printed circuit board (PCB; not shown) is attached to the back of the auxiliary side surface $P_{30}$.

As shown in the drawings, the upper structure of the vertically vibrating hybrid speaker is configured in such a manner that the upper diaphragm 2A and the upper coil C1 are disposed upward and the upper support ring 4A, the upper plate 6A and an upper magnet 8A are located around the outer surface of an upper yoke 10A, based on the barrier $P_{20}$. The space between the barrier $P_{20}$ and the upper diaphragm 2A relatively forms a space without bending or deformation, and the vibration sound of the upper diaphragm 2A is discharged directly through the first sound discharge opening $P_1$ via the above space. In the same manner, the space between the barrier $P_{20}$ and the lower diaphragm 2B relatively forms a linear space without bending or deformation, and the vibration sound of the lower diaphragm 2B is discharged through the second sound discharge opening $P_2$ via the above space. In other words, the vibration sound of the diaphragm may be viewed as being discharged to a side surface along the shortest distance.

Accordingly, according to the present embodiment of the present invention, the acoustic apparatus provides the effect of being able to reproducing a clearer enhanced tone in addition to the above-described effects.

Figure 6A:
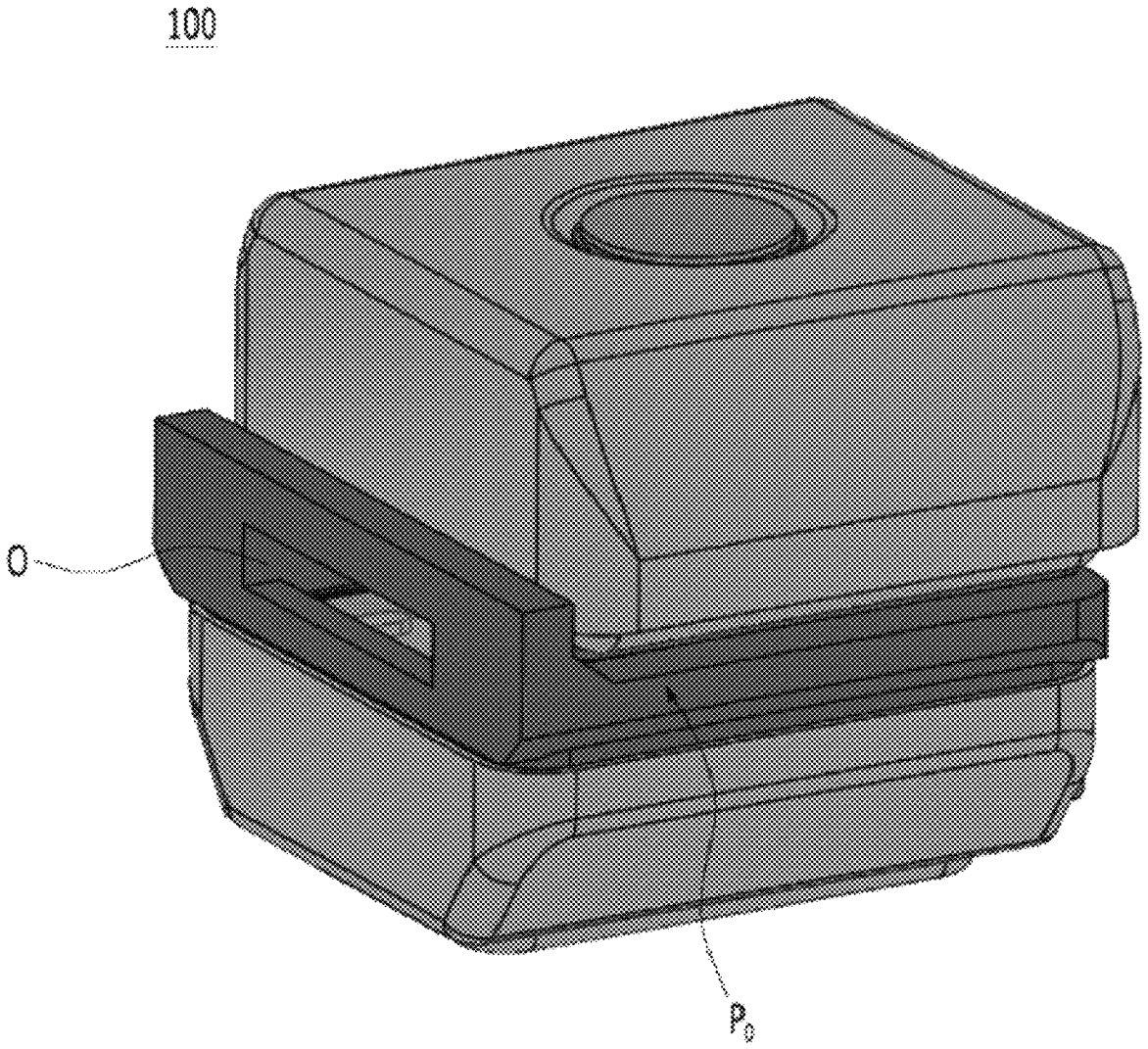
FIG. 6A is a perspective view showing the overall appearance of an acoustic apparatus according to still another embodiment of the present invention.
Figure 6B:
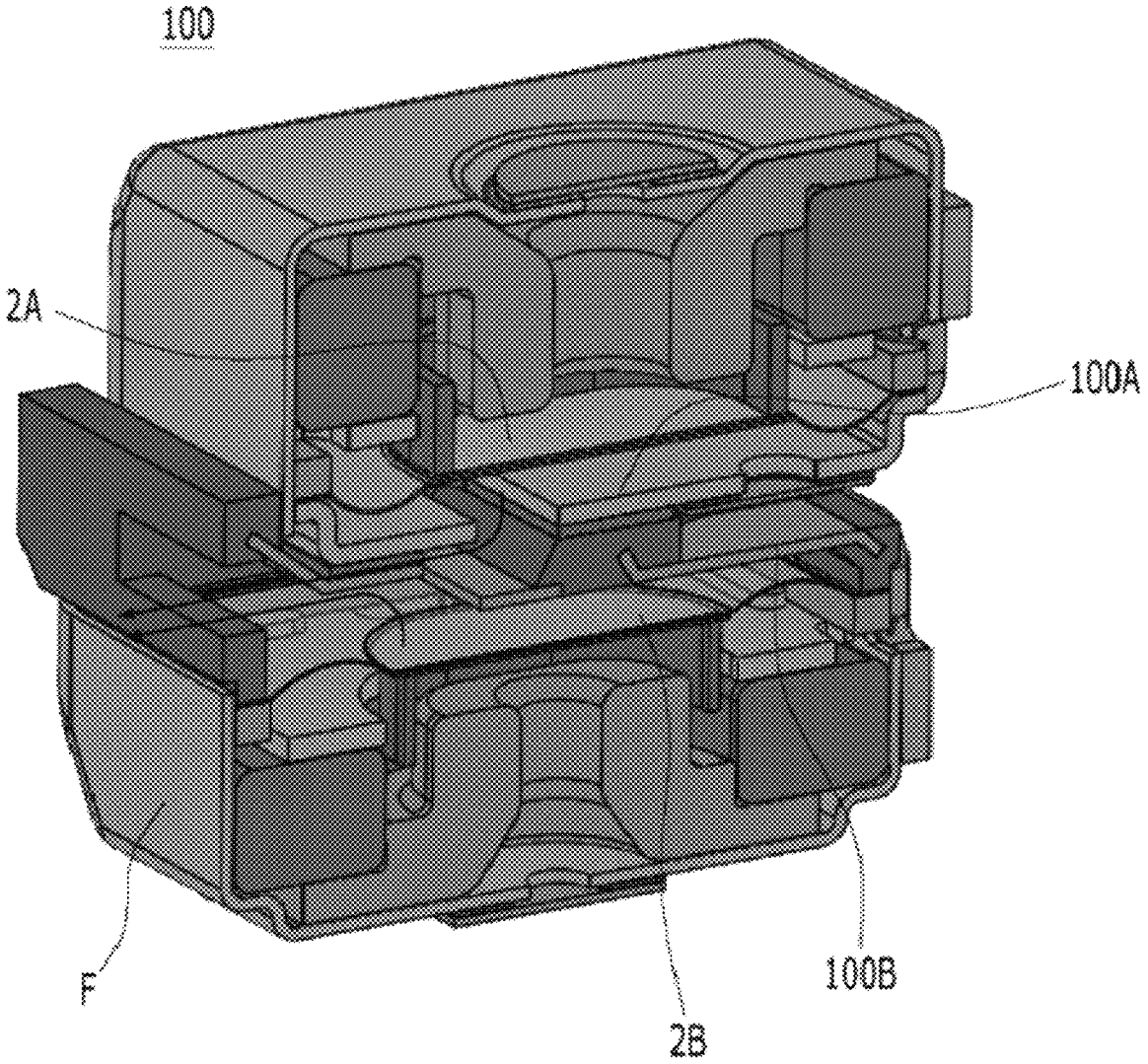
FIG. 6B is a sectional perspective view of the acoustic apparatus shown in FIG. 6A.

FIG. 6A is a perspective view showing the overall appearance of an acoustic apparatus 100 according to still another embodiment of the present invention, and FIG. 6B is a sectional view of FIG. 6A. The acoustic apparatus 100 is generally rectangular because it is based on a rectangular microspeaker. Although in the same manner as the embodiment of FIG. 5, the acoustic apparatus 100 is implemented as a vertically vibrating hybrid speaker and the upper and lower structures of the acoustic apparatus 100 are symmetrical to each other in that the structures are substantially the same, the embodiments are different from each other in terms of the coupling structure of the boundary portion and the sound discharge path.

A plug $P_0$ does block the upper and lower structures from each other, and function to assemble the upper and lower structures. A first horizontal film 100A disposed below an upper diaphragm 2A also functions as a part of a housing, and closes the upper structure. The vibration sound of the upper diaphragm 2A flows toward the sound discharge opening O of the plug $P_0$ through an opening form in the first horizontal film 100A. A second horizontal film 100B is disposed above a lower diaphragm 2B instead of the barrier $P2_0$ across the plug $P_0$. Although the right side of the second horizontal film 100B closes a space, a part of the left side thereof is cut out. The vibration sound of the lower diaphragm 2B passes through the cutout portion, and flows toward the sound discharge opening O of the plug $P_0$. In other words, the vibration sounds of the upper and lower diaphragms 2A and 2B are simultaneously transferred through the single sound discharge opening O formed in a side surface of the frame F.

Accordingly, according to the present embodiment of the present invention, the acoustic apparatus provides the effect of being able to fabricate a rectangular hybrid speaker structure in a more compact form in addition to the above-described effects.

<Acoustic Apparatus Including the Combination of a Balanced Armature and a Speaker>

A hybrid acoustic apparatus according to an embodiment of the present invention, which is formed by combining a microspeaker 1 and a balanced armature (BA) 100F, i.e., a second acoustic device, will be described below. It is advantageous that the BA may be integrated with the rectangular microspeaker 1 of the present invention because the BA generally has a long parallelepiped shape and a sound discharge opening is formed in a long lateral side surface, as are well known.

Figure 7A:
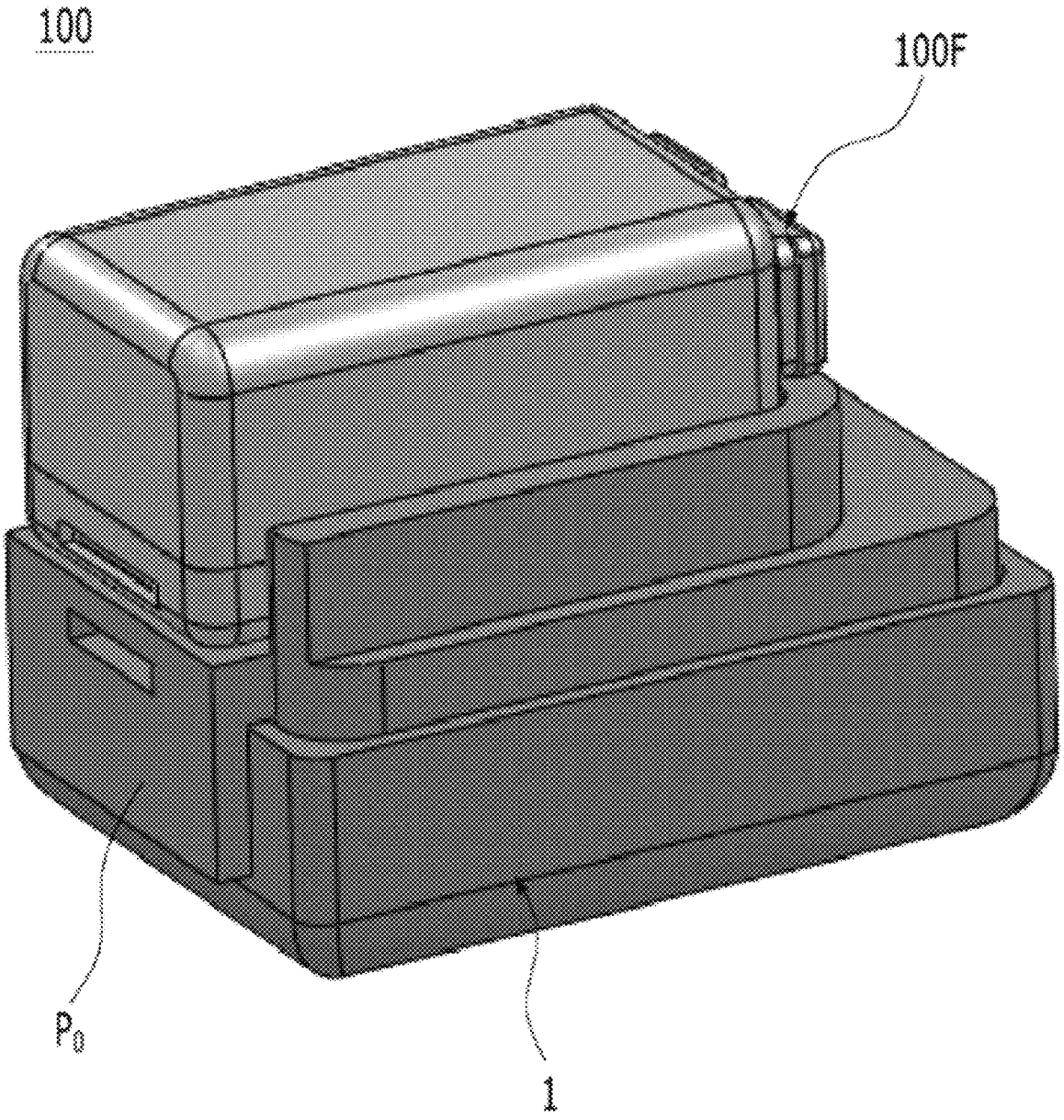
FIG. 7A is a perspective view showing the overall appearance of an acoustic apparatus according to still another embodiment of the present invention.
Figure 7B:
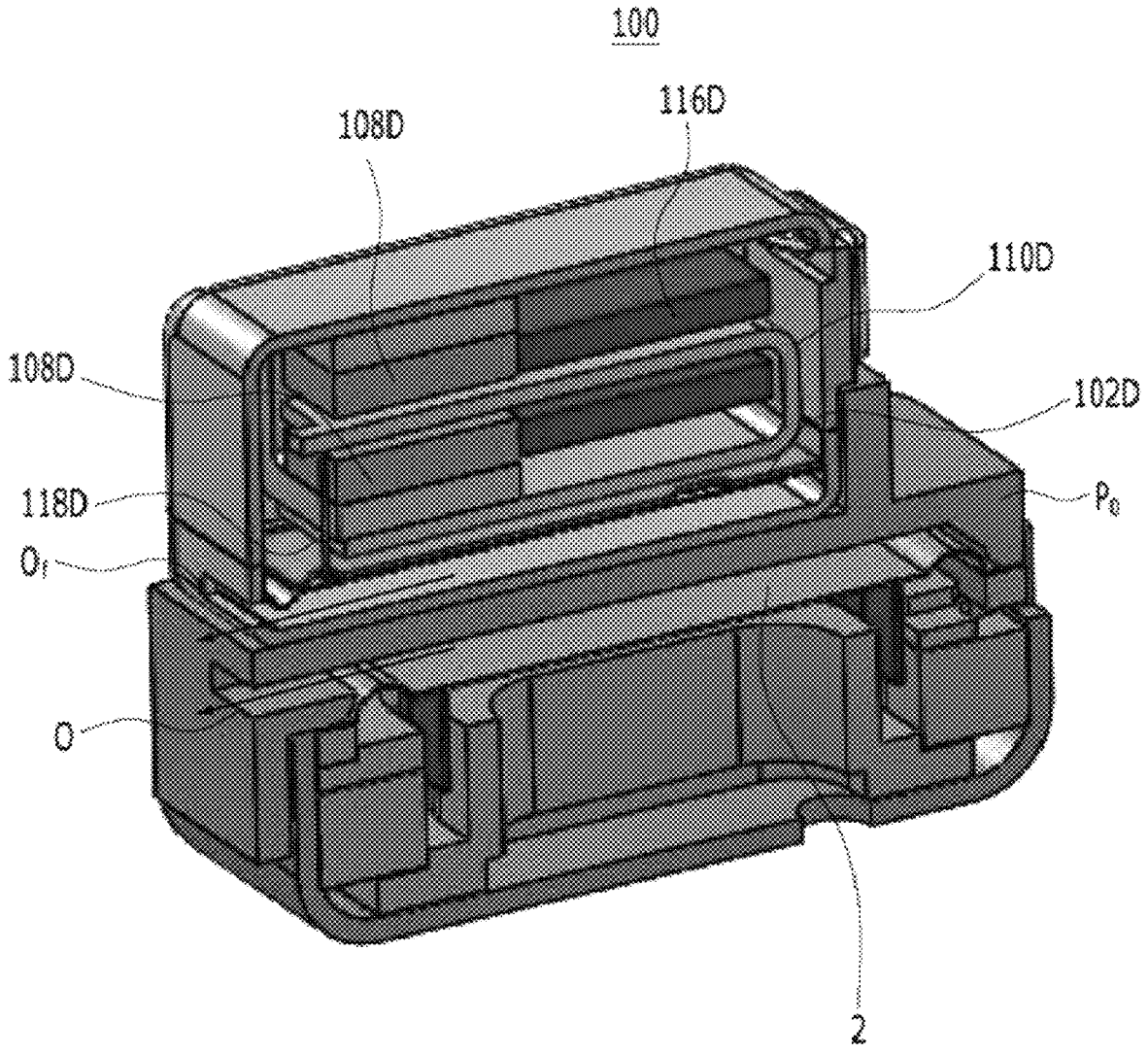
FIG. 7B is a sectional perspective view of the acoustic apparatus shown in FIG. 7A.

FIG. 7A is a perspective view showing the overall appearance of a hybrid acoustic apparatus 100 according to an embodiment of the present invention, and FIG. 7B is a sectional view of FIG. 7A. The acoustic apparatus 100 is formed by combining a rectangular microspeaker 1 located in the lower portion of the acoustic apparatus 100 and a rectangular BA 100F located in the upper portion of the acoustic apparatus 100. The locations of the microspeaker 1 BA 100F may be changed, and the structures thereof may also be changed.

As is well known, the BA 100F includes a BA diaphragm 102D, an armature 110D, a BA magnet 108D, a BA coil 116D, and a driving pin 118D, and the appearance of the BA 100F is surrounded by a case. A BA sound discharge opening $O_f$ is formed in the lower portion of a side of the case. When current flows to the BA coil 116D, the armature 110D vibrates. As the BA diaphragm 102D vibrates vertically via the driving pin 118D vertically disposed at an end of the armature 110D, a spatial volume between the BA diaphragm 102D and the case bottom surface is changed, and this change is discharged to the outside through the BA sound discharge opening $O_f$ in the form of a vibration sound. Since the microspeaker 1 has the same structure as the above-described microspeaker, a detailed description thereof will be omitted.

The communication between the microspeaker 1 and the BA 100F is blocked by a plug $P_0$ that passes between the two components. Accordingly, the sound wave of the BA 100F flows through the BA sound discharge opening $O_f$ toward the sound discharge opening O, the vibration sound of the microspeaker 1 flows through the space between the diaphragm 2 and the plug $P_0$ toward the sound discharge opening O, and the sound wave and the vibration sound are independently discharged to a side surface.

Figure 8A:
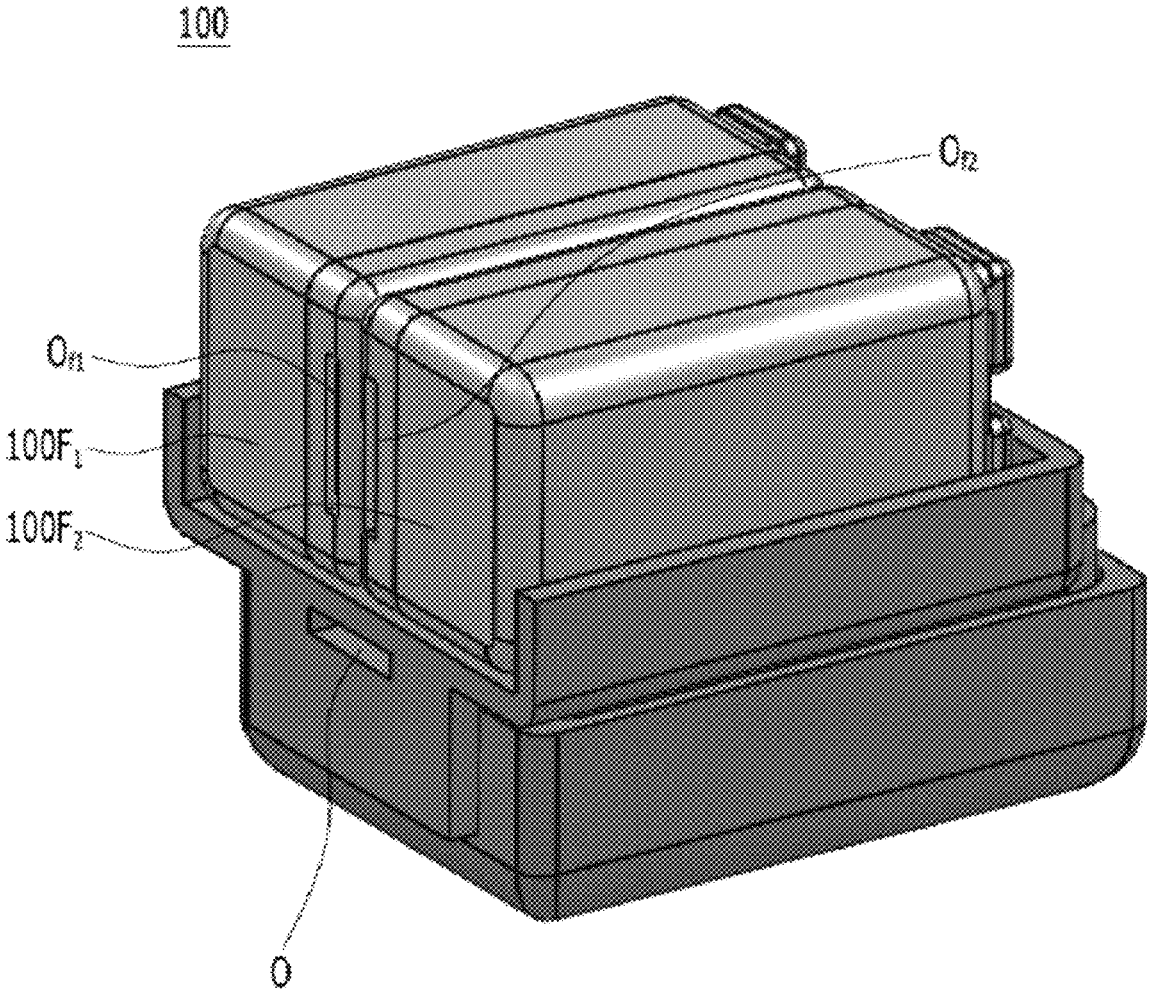
FIG. 8A is a perspective view showing the overall appearance of an acoustic apparatus according to still another embodiment of the present invention.
Figure 8B:
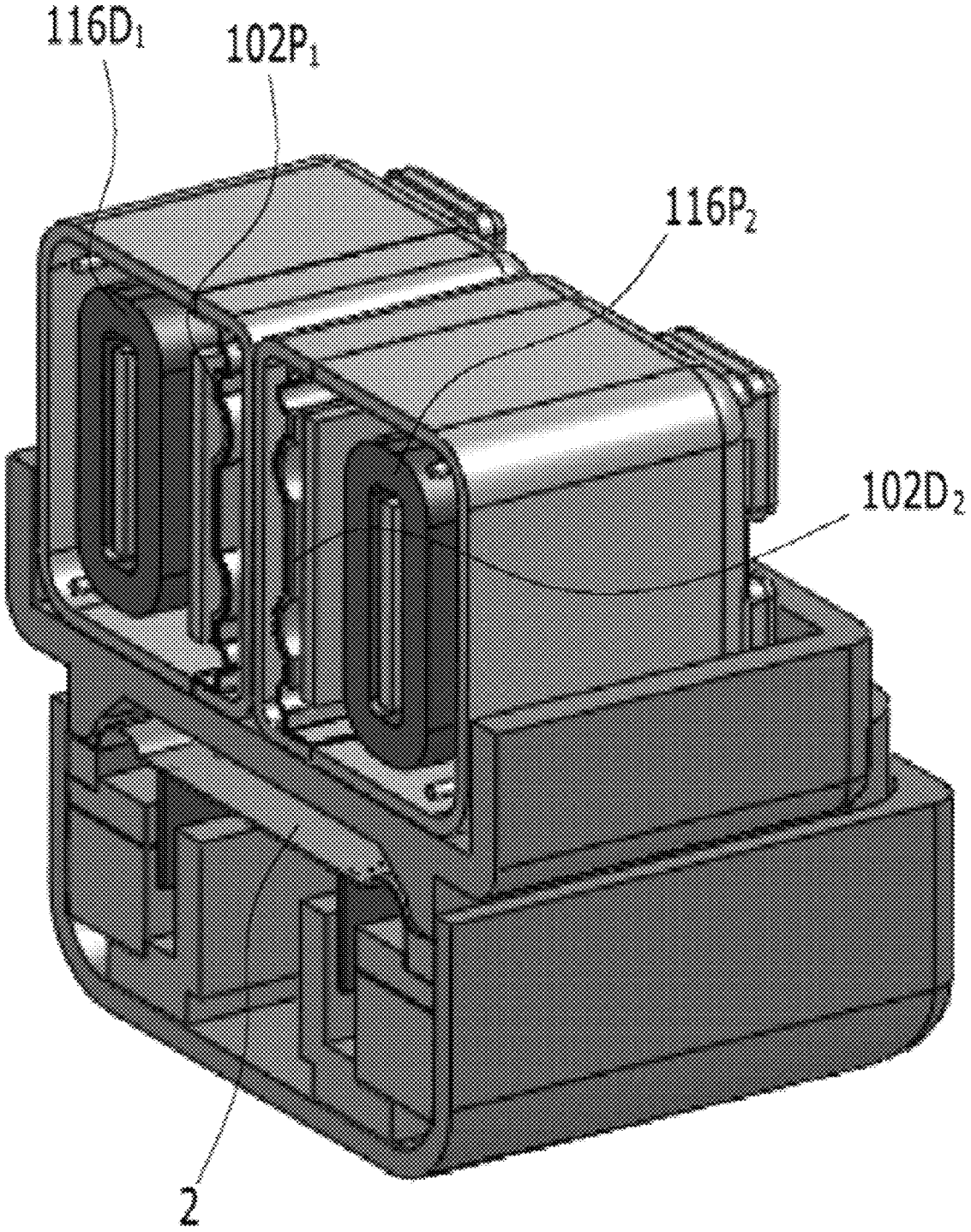
FIG. 8B is a sectional perspective view of the acoustic apparatus shown in FIG. 8A.

FIG. 8A is a perspective view showing the overall appearance of a hybrid acoustic apparatus 100 according to another embodiment of the present invention, and FIG. 8B is a sectional view of FIG. 8A. Although the embodiment of FIG. 8 is basically the same as the embodiment of FIG. 7, they are different from each other in that first and second BAs $100F_1$ and $100F_2$ are disposed in the upper portion of the hybrid acoustic apparatus 100, a single microspeaker 1 is disposed in the lower portion of the hybrid acoustic apparatus 100, and vibration sounds are discharged through three sound discharge openings $O_{f1}$, $O_{f2}$, and O, as shown in the drawings. Unlike in FIG. 7, the pair of BAs $100F_1$ and $100F_2$ are erected and disposed close to each other in order to enhance a volume through the concentrated disposition of the sound discharge openings $O_{f1}$, $O_{f2}$, and O. The sound wave of the first BA diaphragm 102$D_1$ of the first BA 100$F_1$ flows through the first BA sound discharge opening $O_{f1}$ toward the sound discharge opening O, the sound wave of the second BA diaphragm 102$D_2$ of the second BA 100$F_2$ flows through the second BA sound discharge opening $O_{f2}$ toward the sound discharge opening O, the vibration sound of the microspeaker 1 flows through the space between the diaphragm 2 and the plug $P_0$ toward the sound discharge opening O, and the sound waves and the vibration sound are independently discharged through a side surface of the hybrid acoustic apparatus 100.

<Hybrid Acoustic Apparatus Including Microspeaker and Microphone>

Figure 9A:
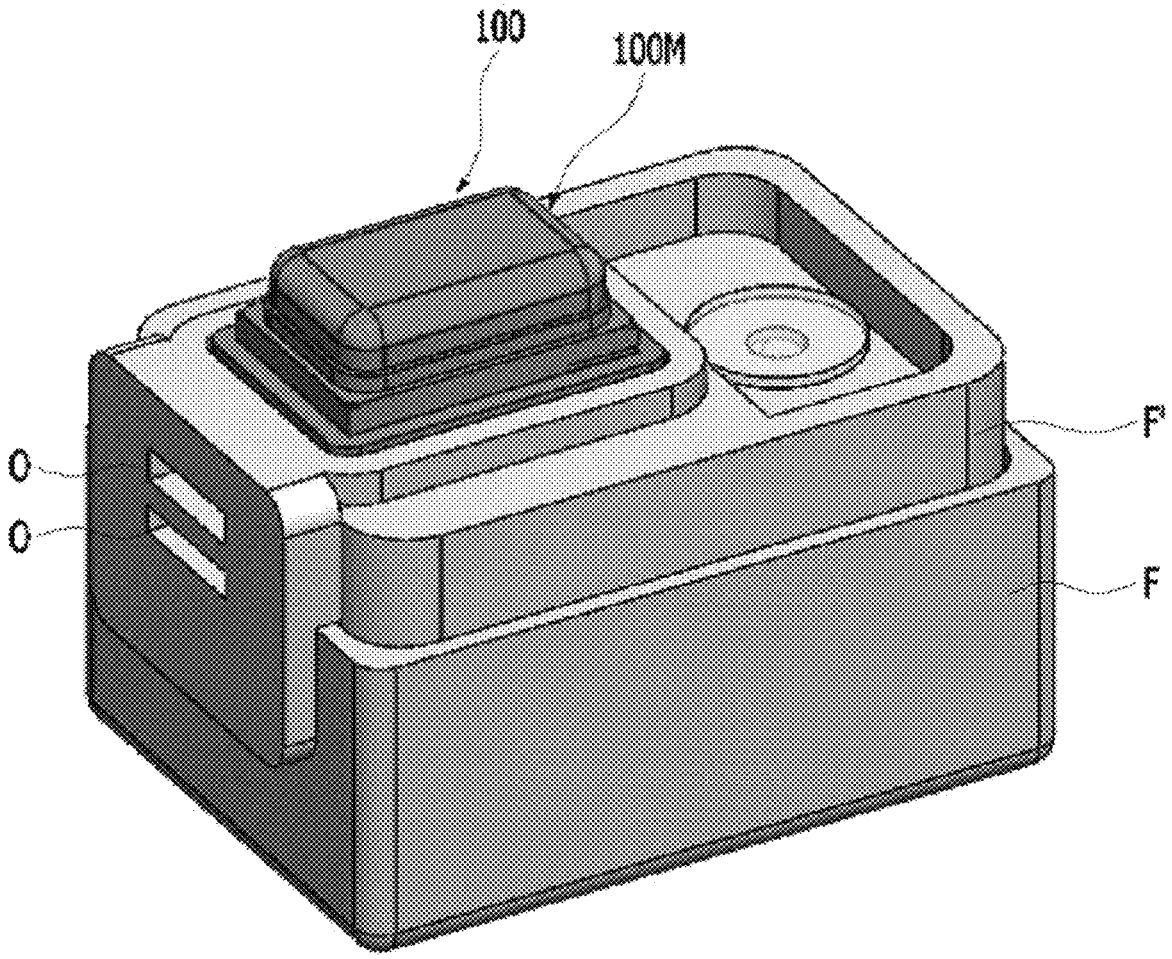
FIG. 9A is a perspective view showing the overall appearance of an acoustic apparatus according to still another embodiment of the present invention.
Figure 9B:
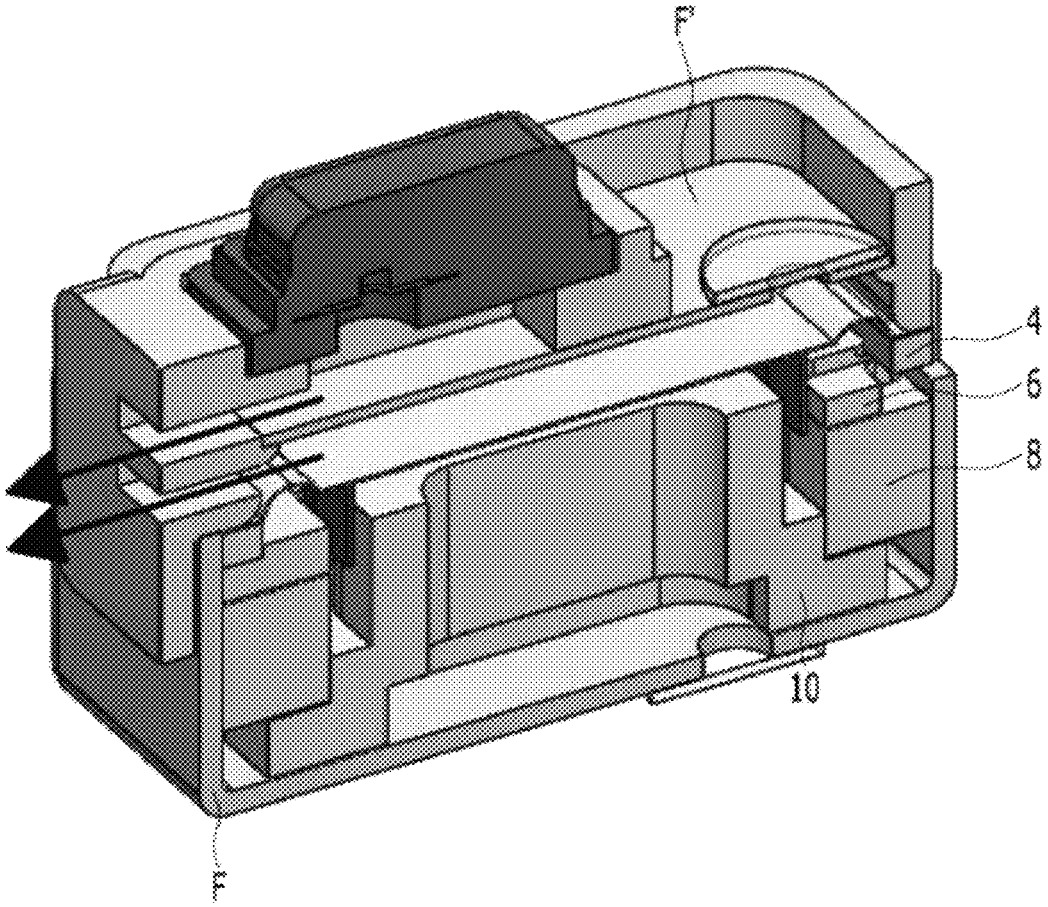
FIG. 9B is a sectional perspective view of the acoustic apparatus shown in FIG. 8A.
Figure 10:
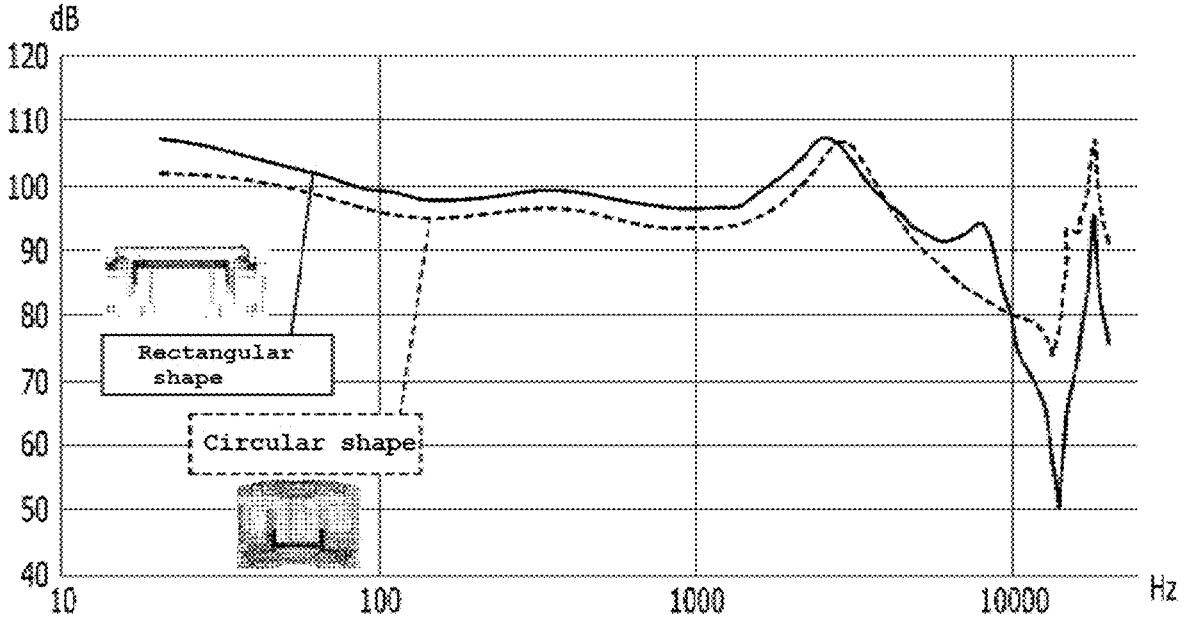
FIG. 10 is a frequency-sound pressure graph comparing a rectangular microspeaker and a circular microspeaker.

FIGS. 9A and 9B disclose a hybrid acoustic apparatus 100 in which the basic structure of a microspeaker according to the present invention is disposed in the lower portion thereof, a microphone 100M is disposed in the upper portion thereof as a second acoustic device, and two sound discharge openings O are formed in a side surface thereof.

An upper frame F' configured to accommodate the microphone 100M is designed to also function as a grill G. In other words, the grill G is a part of the configuration of the upper frame F'. Parallel paths are formed above and below the grill G, and communicate with the sound discharge openings O, respectively. An advantage of the embodiment of FIG. 9 is that the upper frame F' configured to also function as the grill G is fabricated through insert molding and thus there is no need to separately fabricate the grill G. Using this principle, various electronic components, such as a BA, in addition to the microphone 100M may be easily coupled, combined or bonded to the basic structure of the micro speaker 1 of the present invention.

The present invention adopts the rectangular microspeaker, and provides the effects of increasing an effective vibration area and expanding an internal space without the loss of magnetic flux density.

Furthermore, the present invention provides the effect of dividing a frequency band and thus reproducing more stereophonic and livelier sound through the combination of a rectangular microspeaker and another acoustic device integrated with the rectangular microspeaker.

Although the present invention has been described in conjunction with the preferred embodiments, the present invention is not limited to the embodiments, but various modifications and alterations may be made to the present invention without departing from the spirit of the present invention by a person having ordinary skill in the art to which the present invention pertains.

What is claimed is:

1. A hybrid acoustic apparatus comprising:

a rectangular microspeaker used as a first acoustic device; and a second acoustic device integrated with the microspeaker;

wherein the microspeaker includes a plate configured to constitute a part of a magnetic field part, a magnet configured to be disposed beneath the plate, a diaphragm configured to be disposed on the plate, and a frame configured to accommodate the diaphragm, the plate, and the magnet, and wherein a path of vibration sound generated by the diaphragm is formed to be perpendicular to a direction in which the diaphragm vibrates so that the vibration sound is discharged through a side surface of the diaphragm, wherein the second acoustic device is any one of another microspeaker, a balanced armature (BA), and a microphone disposed above or below the microspeaker to discharge the vibration sound through a same side surface as the microspeaker, and wherein the acoustic apparatus is a hybrid acoustic apparatus including a microspeaker and a BA, communication between the microspeaker and the BA is blocked by a plug that passes between the microspeaker and the BA, and a sound wave of the BA flows through a BA sound discharge opening toward a sound discharge opening, a vibration sound of the microspeaker flows through a space between the diaphragm and the plug toward the sound discharge opening, and the sound wave and the vibration sound are independently discharged through the side surface.

2. A hybrid acoustic apparatus comprising:

a rectangular microspeaker used as a first acoustic device; and a second acoustic device integrated with the microspeaker;

wherein the microspeaker includes a plate configured to constitute a part of a magnetic field part, a magnet configured to be disposed beneath the plate, a diaphragm configured to be disposed on the plate, and a frame configured to accommodate the diaphragm, the plate, and the magnet, and wherein a path of vibration sound generated by the diaphragm is formed to be perpendicular to a direction in which the diaphragm vibrates so that the vibration sound is discharged through a side surface of the diaphragm, wherein the second acoustic device is any one of another microspeaker, a balanced armature (BA), and a microphone disposed above or below the microspeaker to discharge the vibration sound through a same side surface as the microspeaker, and wherein the acoustic apparatus is a hybrid acoustic apparatus including a microspeaker and a microphone, an upper frame configured to accommodate the microphone also functions as a grill of the microspeaker, and parallel paths are formed above and below the grill and communicate with the sound discharge opening.

* * * * *